US005978625A

United States Patent [19]

Park

[11] Patent Number: 5,978,625

[45] Date of Patent: Nov. 2, 1999

[54] PHOTOSENSITIVE BELT RECEIVING CASE

[75] Inventor: Geun-yong Park, Suwon, Rep. of Korea

[73] Assignee: Samsung Electronics Co., Ltd., Kyungki-do, Rep. of Korea

[21] Appl. No.: 09/025,148

[22] Filed: Feb. 18, 1998

[30] Foreign Application Priority Data

Jul. 16, 1997 [KR] Rep. of Korea ..... 97-33255

[51] Int. Cl.[6] ..... G03G 21/16

[52] U.S. Cl. ..... 399/116; 399/162; 399/165

[58] Field of Search ..... 399/116, 162, 399/165

[56] References Cited

U.S. PATENT DOCUMENTS 5,400,121 3/1995 Foote ..... 399/116

5,417,322 5/1995 Jeran et al. ..... 399/116

5,708,924 1/1998 Shogren et al. ..... 399/116

*Primary Examiner*—Arthur T. Grimley

*Assistant Examiner*—William A. Noē

*Attorney, Agent, or Firm*—Sughrue, Mion, Zinn, Macpeak & Seas, PLLC

[57] ABSTRACT

A photosensitive belt receiving case is provided, which includes a sidewall having a predetermined shape and an outer wall which extends from the edge of the sidewall. A plurality of grooves are formed at opposing sides of a portion of the outer wall combined with the sidewall. An inner wall extending from the sidewall parallel to the outer wall is provided inside the outer wall, and has a plurality of grooves which face the grooves of the outer wall, so that a photosensitive belt is received between the outer and inner walls and the edge of the photosensitive belt is partially exposed through the grooves.

5 Claims, 3 Drawing Sheets

PHOTOSENSITIVE BELT RECEIVING CASE

BACKGROUND OF THE INVENTION

1. Field of the Invention

The present invention relates to a case for receiving a photosensitive belt in a printer or a photocopying machine.

2. Description of the Related Art

A general printing apparatus such as a printer or a photocopying machine, as shown in FIG. 1, includes a photosensitive belt 10 having a surface on which an image to be printed is formed by a developing unit 20 while circulating and being supported by a plurality of rollers 11, 12 and 13 installed in the main body of the printing apparatus. If the photosensitive belt 10 is used for a long time, the accuracy of the formed picture is lowered. Thus, the photosensitive belt 10 must be replaced periodically with a new belt. During replacement, the photosensitive belt 10 is manually combined with the rollers 11, 12 and 13. Accordingly, the replacement is awkward and difficult due to the significant flexibility of the photosensitive belt. Furthermore, this difficulty may result in improper replacement, causing a malfunction of the printing apparatus.

SUMMARY OF THE INVENTION

To solve the above problems, an object of the present invention is to provide a photosensitive belt receiving case which can facilitate the replacement and installation of the photosensitive belt.

To accomplish the above objective, a photosensitive belt receiving case is provided, comprising: a sidewall having a predetermined shape; an outer wall which extends from the edge of the sidewall, and on which a plurality of grooves are formed at opposing sides of a portion combined with the sidewall; and an inner wall extending from the sidewall parallel to the outer wall inside the outer wall, and having a plurality of grooves which face the grooves of the outer wall, wherein a photosensitive belt is received between the outer and inner walls and the edge of the photosensitive belt is partially exposed through the grooves.

BRIEF DESCRIPTION OF THE DRAWINGS

The above object and advantage of the present invention will become more apparent by describing in detail a preferred embodiment thereof with reference to the attached drawings in which.

DESCRIPTION OF THE PREFERRED EMBODIMENT

Figure 1:
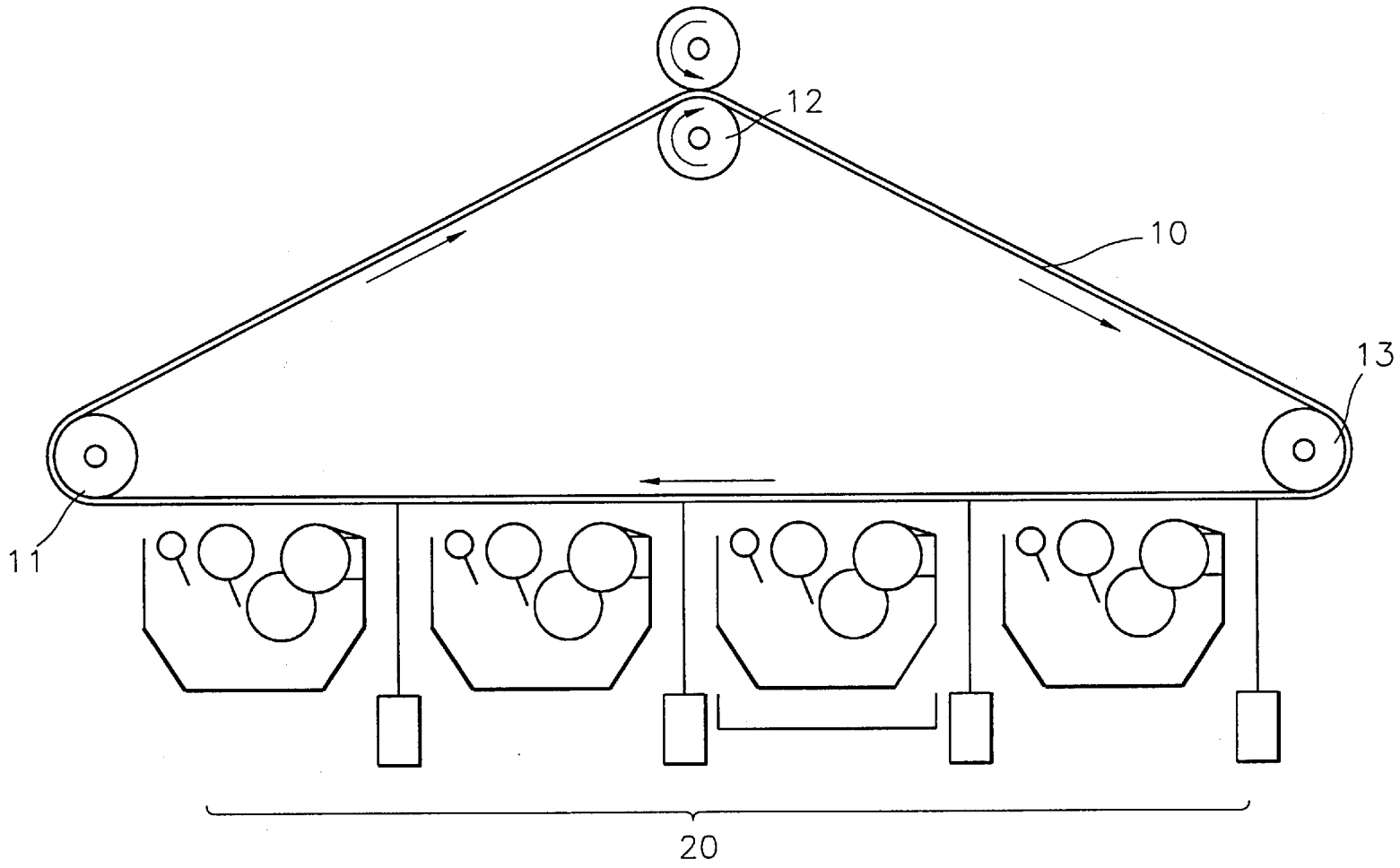
FIG 1 (PRIOR ART)
FIG. 1 is a schematic diagram of a photosensitive belt installed inside a general printing apparatus.
Figure 2:
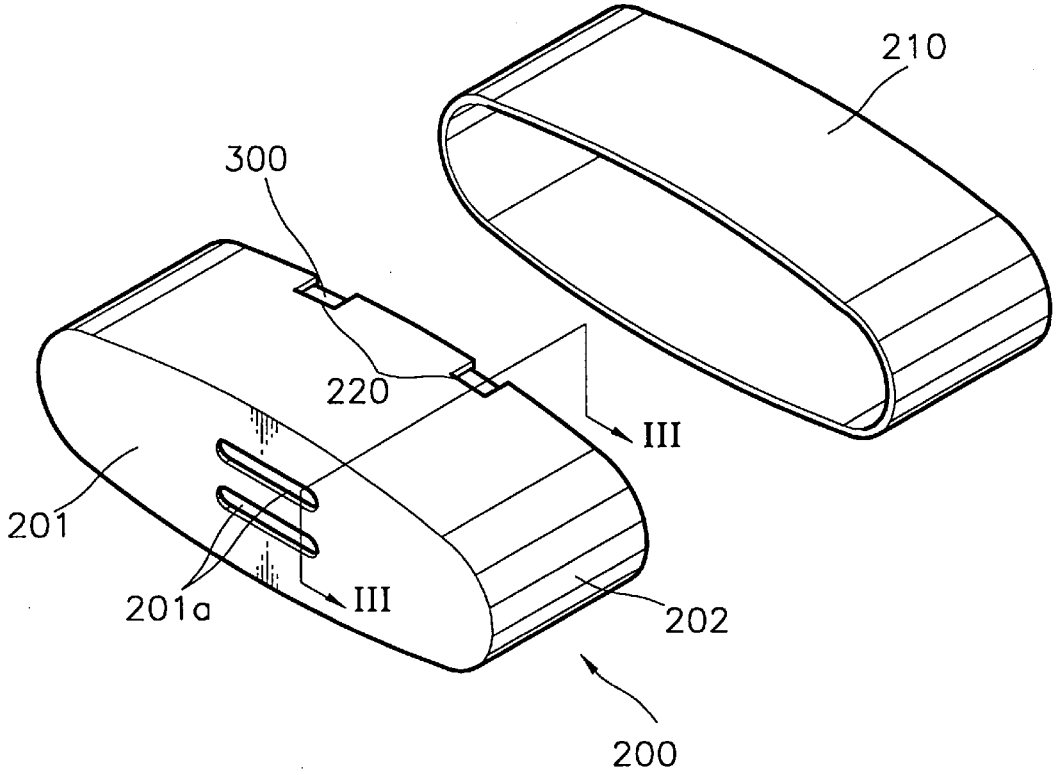
FIG. 2 is a perspective view of a photosensitive belt receiving case according to the present invention.
Figure 3:
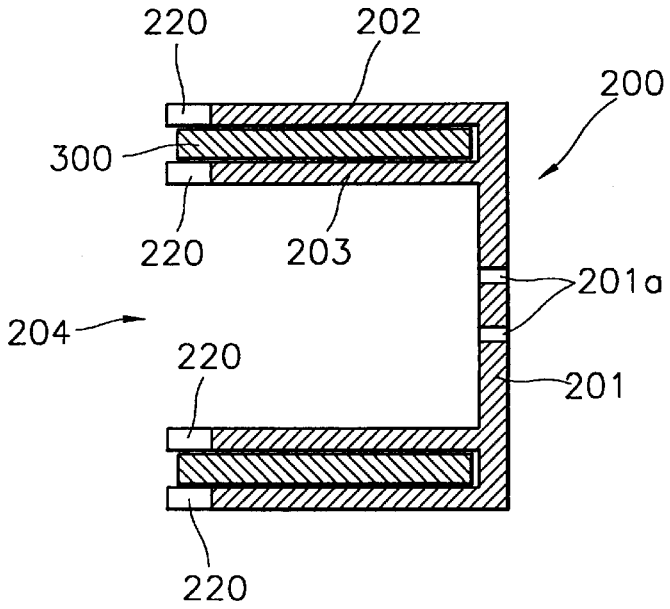
FIG. 3 is a cross-sectional view, taken along line III—III, of FIG. 2.

Referring to FIGS. 2 and 3, a photosensitive belt receiving case 200 according to the present invention has one open side 204, an oval sidewall 201, an external wall 202 extending from the edge of the sidewall 201, and an internal wall 203 formed parallel to the inner surface of the external wall 202. The photosensitive belt 300 is inserted between the external and internal walls 202 and 203.

A plurality of corresponding grooves 220 are formed on opposite edges of the external and internal walls 202 and 203 at the open side 204. Thus, the edges of the received photosensitive belt 300 are exposed through the grooves 220. A hole 201*a* for picking up the case 200 manually is formed on the sidewall 201. Also, the photosensitive belt receiving case of the present invention can further include a cover/lid 210 coupled to the open side 204 to cover the external wall 202 in order to protect the photosensitive belt 300 received in the case.

Figure 4:
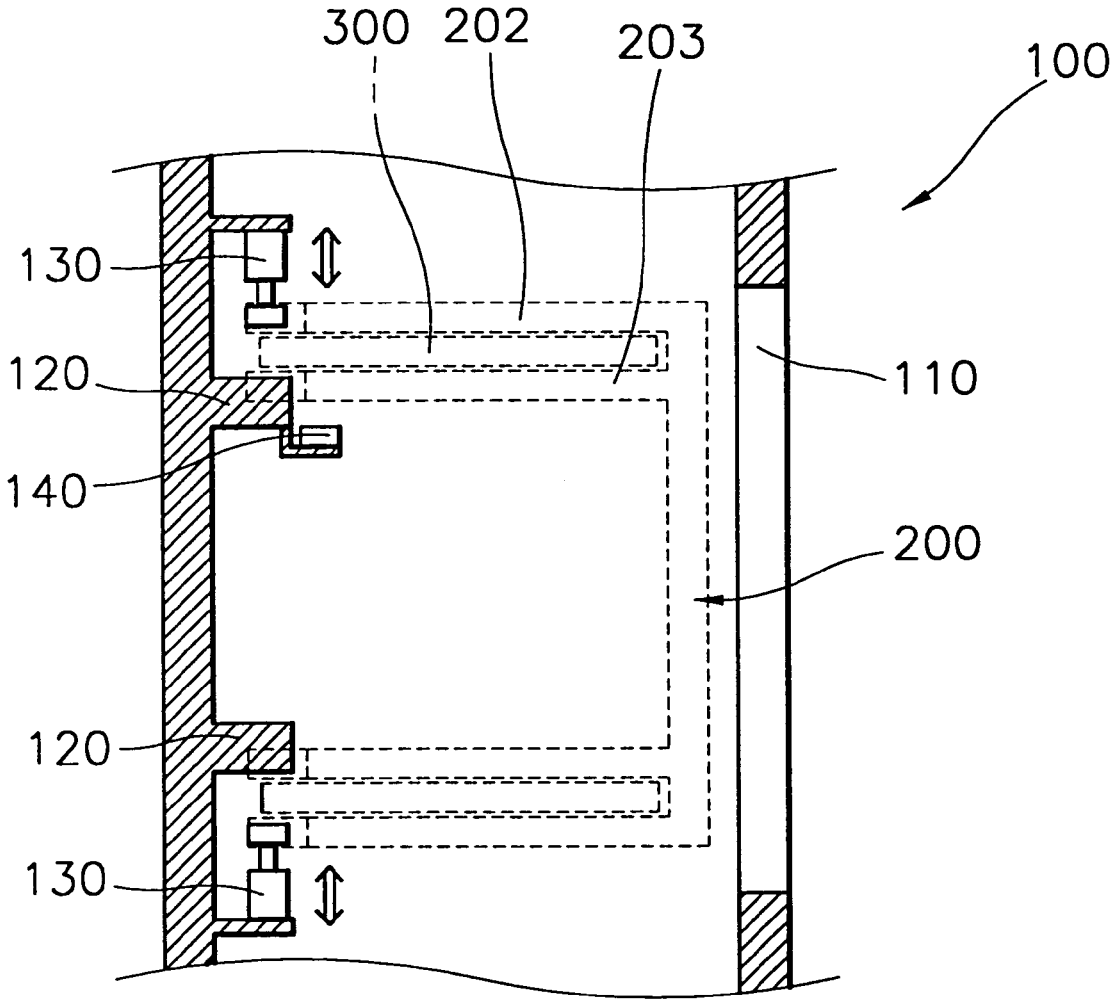
FIG. 4 is a cross-sectional view for illustrating a procedure for loading a photosensitive belt in the main body of a printing apparatus using the photosensitive belt receiving case according to the present invention.

The photosensitive belt received in the photosensitive belt receiving case according to the present invention is loaded in a printing apparatus including a photosensitive belt loading device shown in FIG. 4. Referring to the drawing, the photosensitive belt loading device included in a main body 100 of a printing apparatus comprises a guide protrusion 120 which is formed in the main body 100 of the printing apparatus and inserts into the groove 220 formed on the inner wall 203 of the photosensitive belt receiving case 200 (see FIG. 2), and a solenoid cylinder 130 facing the guide protrusion 120. During loading of the photosensitive belt 300, the solenoid cylinder 130 clamps the end of the photosensitive belt 300 which is exposed through the groove 200. A sensor 140 detects the entry of the photosensitive belt 300.

When a new photosensitive belt is loaded in the main body 100 of the printing apparatus, the photosensitive belt receiving case 200 having the photosensitive belt 300 is inserted into the main body 100 of the printing apparatus through an opening 110, as shown in FIG. 4. The guide protrusion 120 is inserted into the groove 220 (see FIG. 3) formed on the inner wall 203 of the case 200, to align the case 200. Also, the end of the photosensitive belt 300, exposed through the groove 220, is placed on the upper surface of the guide protrusion 120. The position of the photosensitive belt 300 in this state is detected by the sensor 140.

The solenoid cylinder 130 is lowered to press the upper surface of the end of the photosensitive belt 300 exposed through the groove 220 against the guide protrusion 120. When the case 200 is pulled out of the main body 100 of the printing apparatus through the opening 110, the photosensitive belt 300 is clamped by the guide protrusion 120 and the solenoid cylinder 130 so that it slides out of the case 200. Then, the solenoid cylinder 130 returns to its original position, thereby completing the loading of the photosensitive belt 300.

As described above, the photosensitive belt receiving case according to the present invention receives a flexible photosensitive belt in a fixed shape. Thus, during replacement and loading of the photosensitive belt, only the case is inserted into the main body of the printing apparatus, so that the photosensitive belt can be simply loaded.

The above description of the preferred embodiments has been given by way of example. From the disclosure given, those skilled in the art will not only understand the present invention and its attendant advantages, but will also find apparent various changes and modifications to the structures disclosed. It is sought, therefore, to cover all such changes and modifications as fall within the spirit and scope of the invention, as defined by the appended claims, and equivalents thereof.

What is claimed is:

1. A photosensitive belt receiving case comprising:

a sidewall having a predetermined shape;

an outer wall which extends from an edge of said sidewall, having a plurality of grooves formed at an open end of said outer wall opposing said sidewall; and an inner wall extending from said sidewall, parallel to said outer wall and inside said outer wall, and having a plurality of grooves which align with said grooves of said outer wall, wherein a photosensitive belt is received between said outer and inner walls and an edge of said photosensitive belt is partially exposed through said grooves of said outer and inner walls.

2. A photosensitive belt receiving case as claimed in claim 1, wherein a hole for grabbing said photosensitive belt receiving case is formed on said sidewall.

3. A photosensitive belt receiving case as claimed in claim 1, further comprising a cover for covering said outer wall so that the open end of said outer wall is closed.

4. A photosensitive belt receiving case as claimed in claim 1, wherein the photosensitive belt is loaded into a main body having a sensor for detecting the photosensitive belt and a protrusion for grabbing the photosensitive belt.

5. A method of loading a photosensitive belt into a main body comprising the steps of:

inserting a photosensitive belt receiving case into the main body having the photosensitive belt held in fixed shape therein;

grabbing the photosensitive belt from the photosensitive belt receiving case wherein, the photosensitive belt is grabbed by a protrusion of the main body which accesses the photosensitive belt via a plurality of grooves formed on the photosensitive belt receiving case; and sliding the photosensitive belt from the photosensitive belt receiving case into the main body.

* * * * *